US005826851A

United States Patent [19]

Arbisi

[11] Patent Number: 5,826,851

[45] Date of Patent: Oct. 27, 1998

[54] PLASTIC MOUNTING MEMBRANE USING ELECTROSTATIC ATTRACTION

[76] Inventor: Dominic S. Arbisi, 13001 Berkshire Dr., Minnetonka, Minn. 55343

[21] Appl. No.: 655,848

[22] Filed: May 31, 1996

[51] Int. Cl.[6] ..... A47F 1/14

[52] U.S. Cl. ..... 248/466; 40/594; 40/777; 108/108; 108/152; 108/161; 248/250

[58] Field of Search ..... 248/467, 205.4, 248/205.3, 466, 205.1, 235, 250; 206/497, 779; 40/594, 777; 108/108, 152, 161

[56] References Cited

U.S. PATENT DOCUMENTS

| | | | |
|---|---|---|---|
| D. 287,816 | 1/1987 | Chasen | 248/205.3 X |
| 2,532,132 | 11/1950 | Vogel | 40/777 X |
| 3,098,272 | 7/1963 | Frye | 248/205.3 X |
| 3,241,795 | 3/1966 | Frye | 248/467 X |
| 3,440,750 | 4/1969 | Toth et al. | 40/140 |
| 3,637,181 | 1/1972 | Janssen | 248/205.3 |
| 3,924,879 | 12/1975 | Wright | 282/28 |
| 4,090,464 | 5/1978 | Bishopp et al. | 40/594 X |
| 4,225,369 | 9/1980 | Felchlin | 40/611 X |
| 4,741,119 | 5/1988 | Baryla | 40/594 |
| 4,992,121 | 2/1991 | Rubino | 156/71 |
| 5,102,171 | 4/1992 | Saetre | 40/594 X |
| 5,110,077 | 5/1992 | Mossini | 248/205.3 |
| 5,307,579 | 5/1994 | Clayton et al. | 40/600 |

*Primary Examiner*—Ramon O. Ramirez
*Attorney, Agent, or Firm*—Moore & Hansen

[57] ABSTRACT

A removable mounting unit for electrostatic mounting of a shelf or hook to a nonporous surface includes a sheet of electrostatic material having an opening to engage the shelf or hook and hold it to the non-porous surface. The removable mounting unit may also include only the electrostatic sheet used to mount a picture or flat object by sandwiching the object between the sheet and a non-porous surface, or by using slits cut into the sheet to hold the corners of the object. The shelf or hook may be directly fused or glued to the electrostatic sheet.

17 Claims, 1 Drawing Sheet

PLASTIC MOUNTING MEMBRANE USING ELECTROSTATIC ATTRACTION

BACKGROUND OF THE INVENTION

The present invention relates generally to apparatus for hanging pictures, shelves, and the like. Specifically, it relates to hanging shelves, and hanging devices such as pictures, hooks, clips and the like with electrostatically charged sheets of material.

Currently, pictures or drawings are often displayed by attaching them to metal surfaces with magnets. They are also displayed in frames sitting on tables or hung on walls with nails or other invasive types of fasteners. The mounting or displaying of pictures or objects with magnets obscures portions of the pictures, and the magnets used may scratch the surface upon which the magnets are used. Additionally, the holding force of magnets is decreased as the thickness of the material mounted or held with the magnet increases. Further, magnets may only be used to hang objects on metallic surfaces. This limits the range of use for magnets to the display of pictures or drawings and the like.

Other methods of display, including hanging frames or pictures on walls with nails, tacks, or other fasteners, involve defacing either the wall, the picture, or both. The use of nails or other invasive fasteners is limited to those surfaces which accept such fasteners. Concrete or brick walls, and even metal surfaces, are not amenable to the easy use of invasive fasteners. Invasive fasteners are rather permanent, and objects hung with them cannot be readily moved without the need for re-invading the mounting surface, repairing the old mounting location, or both. Similarly, affixing pictures to surfaces with adhesives such as tape may also damage the picture or the surface to which the picture is being attached. Adhesive fixing is also not amenable to the easy moving of hung objects due to the potentially destructive nature of such adhesives.

These types of mounting are either limited in the location of application, or incapable of easy relocation, or both. It would be desirable to have a picture hanger, shelf hanger or hook capable of removable mounting to a larger range of surfaces. It would also be desirable to have a picture hanger, shelf hanger or hook that does not damage the picture or the object it is holding, or the surface on which it is mounted.

BRIEF DESCRIPTION OF THE INVENTION

The present invention overcomes the problems of the prior art by providing a removable, light weight, non-abrasive mounting unit capable of mounting flat objects to a nonporous surface, without the use of traditional damaging or invasive adhesive mountings, as well as for mounting a shelf or hanger member to a non-porous surface. Mounting may also be made to a porous surface treated so as to make it non-porous. To accomplish this, the invention uses a sheet of electrostatically charged material, such as that available under the name "Trans-Flex-Cast" as sold by Transilwrap Company, Inc. The sheet is clear, and various slits or openings may or may not be cut into the sheet to accommodate various hanger members, shelves, or flat objects such as photographs. Such hangers or shelves can support objects normally incapable of being hung or perched in locations of use of the sheet, such as on windows, refrigerators, tiles or tile walls and the like.

In one embodiment of the invention, a shelf is mounted to a non-porous surface, the shelf being held to the surface by the electrostatically charged sheet. A mounting plate attached to the shelf fits within an opening cut into the sheet, and the electrostatic force holding the sheet to the mounting surface also holds the shelf to the mounting surface. Alternatively, the shelf could be fused or glued directly to the non-contact side of the electrostatic sheet.

Another embodiment of the invention uses an electrostatic sheet to mount a hanger member such as a hook or clip to a non-porous surface by providing a slit in the electrostatically charged sheet through which a mounting portion of the hanger member may be placed. The electrostatic force holding the sheet to the non-porous surface will also hold the hanger member to the surface. Again, the hanger member could be fused or glued directly to the non-contact side of the electrostatic sheet. In this way, the hanger unit would effectively be of one piece construction. Such gluing or fusing could enhance the stability of the hanger unit.

Yet another embodiment of the invention uses only an electrostatic sheet to mount a photograph or other flat object to a non-porous surface. This may be accomplished in several different ways. First, the electrostatic sheet may be of sufficient size that it completely covers the object, mounting the object to the non-porous surface, by the electrostatic interface between the surface and the non-covering portion of the sheet and also providing a protective covering for the object. Since the sheet is clear, the object may be seen through the sheet. This allows the object to be a photograph or other graphic material and the like. A second use of the electrostatic sheet to mount a photograph or other object to the non-porous surface involves cutting a plurality of slits into the electrostatic sheet in such a configuration as to allow the corners of a photograph or other flat object to be inserted into the slits of the electrostatic sheet. In all instances, the attraction of the electrostatic sheet to the non-porous surface will provide the mounting force to mount the object to the non-porous surface. Such mounting force does not diminish in relation to the thickness of the object being mounted. The force is generated between the electrostatic sheet and its contact with the non-porous surface.

The invention may also be used for mounting on various porous surfaces that are treated with a polyurethane spray which creates a non-porous surface. Wood, brick, ceramic, concrete, and the like may be so treated.

These and other benefits of the present invention will become apparent from the following detailed description thereof taken in conjunction with the accompanying drawings, wherein like reference numerals designate like elements throughout the several views.

DESCRIPTION OF THE PREFERRED EMBODIMENTS

Figures 1, 2, 3, 4, 5, 6, 7, 8, 9:
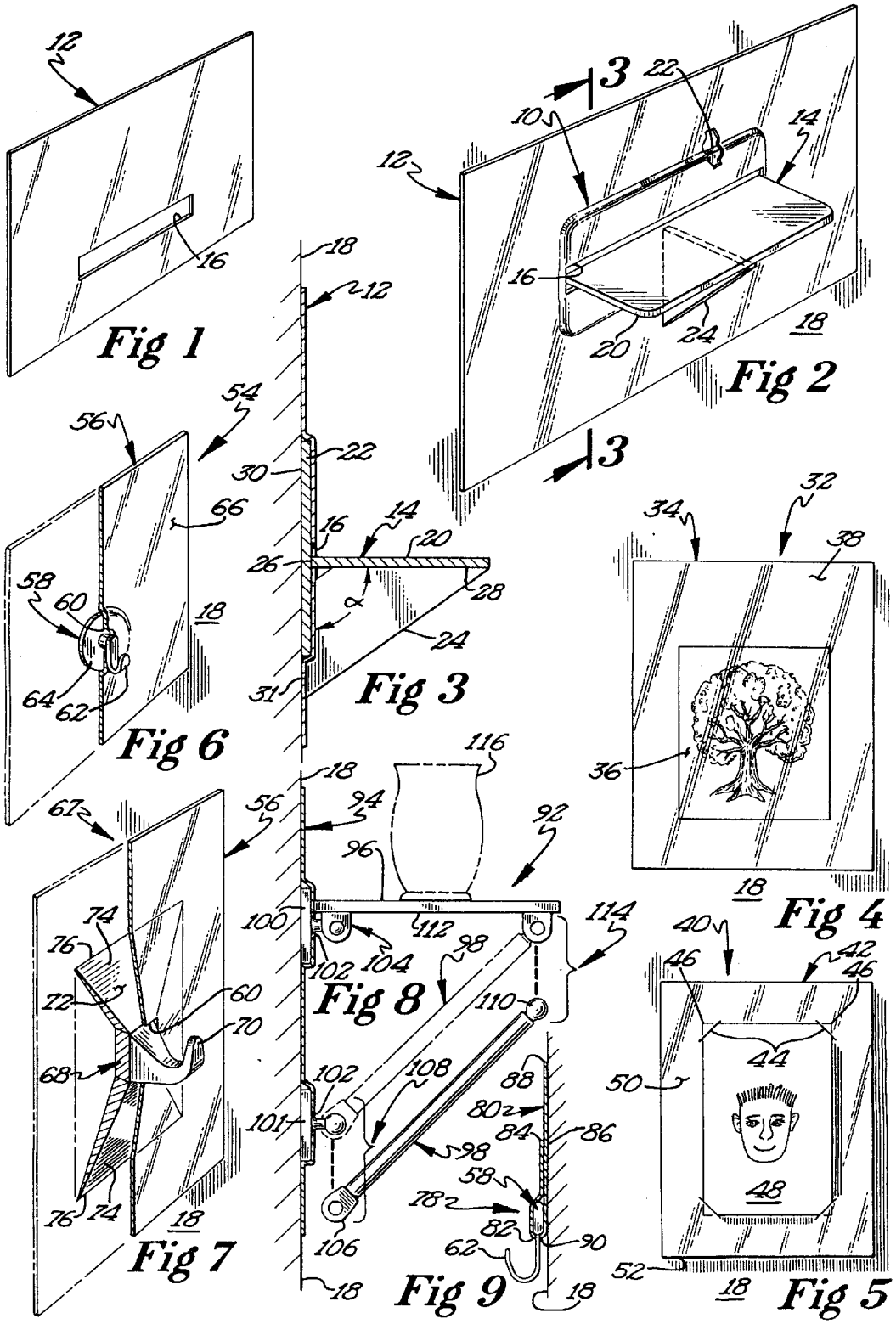
FIG. 1 is a perspective view of an electrostatic sheet.
FIG. 2 is a perspective view of an embodiment of the removable hanger unit.
FIG. 3 is a side view of the embodiment of the removable hanger unit shown in FIG. 2.
FIG. 4 is a view of a second alternative embodiment of the removable hanger unit.
FIG. 5 is a view of a third alternative embodiment of the removable hanger unit.
FIG. 6 is a perspective view of an alternative embodiment of a hanger member.
FIG. 7 is a perspective view of another alternative embodiment of a hanger member.
FIG. 8 is a view of a fourth alternative embodiment of the removable hanger unit.
FIG. 9 is a side view of a fifth alternative embodiment of the removable hanger unit.

Referring now to the drawings, a removable hanger unit 10 may be seen in its various embodiments. FIGS. 1–3 show a removable hanger unit 10 embodied as an electrostatically charged sheet 12 and a shelf 14. The sheet 12 has an opening 16 cut therein, to accommodate mounting of the shelf 14 and the sheet 12 to a non-porous surface 18. Sheet 12 must be capable of forming an electrostatic interface with surface 18, in order to allow sheet 12 to be mounted to surface 18 without requiring the use of any adhesive or invasive fasteners. A material useable for sheet 12 is manufactured under the name "Trans-Flex-Cast" as sold by Transilwrap Company, Inc.

Shelf 14 comprises a shelf plate 20, a backing plate 22, and a shelf brace or support 24. Backing plate 22 is attached to the back edge 26 of shelf plate 20 by known means such as gluing or heat fusion. Backing plate 22 and shelf plate 20 are substantially perpendicular to one another, so that when backing plate 22 engages opening 16 in sheet 12 and is mounted to surface 18 by the electrostatic attraction between surface 18 and sheet 12, shelf plate 20 will be substantially perpendicular to surface 18. In this mounting scheme, backing plate 22 is sandwiched between surface 18 and sheet 12. Most often, surface 18 will be substantially vertical in orientation, so that shelf plate 20 is substantially parallel to the ground, and therefore substantially perpendicular to surface 18. Shelf brace or support 24 is attached to bottom 28 of shelf plate 20 to provide further support for shelf 14. The weight of shelf plate 20 has a tendency to cause shelf plate 20 and backing plate 22 to attempt to pull away from the surface 18. The addition of shelf brace 24 serves to prevent such tendencies. Shelf brace or support 24 is preferably shaped as a right triangle with a right angle vertex $\alpha$ at the intersection of backing plate 22 and bottom 28 of shelf plate 20. This shaping of shelf brace 24 allows brace 24 to perform its support function as well as maintaining the aesthetics of shelf 14. Alternatively, brace 24 may be shaped in other configurations, such as curves, as long as brace 24 provides support between shelf plate 20 and surface 18 to prevent the hanger member from pulling away from surface 18.

As an alternative to mounting shelf 14 by the insertion of backing plate 22 through opening 16 in sheet 12, other methods of allowing the electrostatic attraction between surface 18 and sheet 12 to effectively support shelf 14 may be used. For example, backing plate 22 of shelf 14 may be glued to sheet 12, eliminating the need for opening 16. Also, shelf 14 may be fused to sheet 12, also eliminating the need for opening 16.

Shelf plate 20, backing plate 22, and shelf brace or support 24 are preferably made of lightweight plastic. Other materials that are of sufficiently light weight would also be suitable. Such materials include strengthened corrugated cardboard with a plastic coating. Alternatively, shelf 14 may be molded as one piece.

Shelf 14 is mounted as follows and as shown best in FIG. 2–3. Backing plate 22 is inserted into opening 16 cut into sheet 12. Opening 16 is preferably rectangular, and is smaller than backing plate 22, so that when backing plate 22 has been inserted into opening 16, the sheet 12 will overlap backing plate 22. Sheet 12 may then be electrostatically mounted to a non-porous surface 18. Acceptable surfaces 18 that will provide an electrostatic interface with sheet 12 include, but are not limited to, metal, glass, plastic, and other non-porous surfaces. Additionally, application of a polyurethane spray or layer applied by other means such as a brush to other surfaces such as wood, brick, ceramic, concrete and the like, will create a non-porous surface that is also capable of forming an electrostatic interface with sheet 12. The electrostatic attraction between surface 18 and sheet 12 serves to hold shelf 14 to surface 18, with the back surface 30 of backing plate 22 adjacent surface 18. Shelf brace or support 24 serves to further stabilize shelf 14. Brace 24 helps to support shelf 14 by allowing some of the weight of shelf plate 20 to be borne by surface 18 through brace 24. Back edge 31 of brace 24 bears against surface 18 for this purpose. Alternatively, as has been mentioned, backing plate 22 could be fused or glued to sheet 12 for another means of mounting shelf 14.

Another embodiment of the removable hanger unit is designated as reference numeral 32, and is best shown in FIG. 4. Hanger 32 comprises a sheet 34 of electrostatic material, which is mounted to a non-porous surface 18 in such a manner that a photograph or other flat object 36 is completely covered by sheet 34. The area 38 of sheet 34 that does not cover object 36 electrostatically adheres to surface 18 to hold object 36 to surface 18, with object 36 sandwiched between sheet 34 and surface 18.

Another embodiment of the removable hanger unit is shown in FIG. 5, and is designated as numeral 40. Hanger 40 comprises an electrostatic sheet 42 with a plurality of slits or openings 44 cut therein. Slits or openings 44 are spaced so that the corners 46 of a photograph or other flat object 48 may be inserted into slits 44 to mount object 48 to electrostatic sheet 42. Photograph or object 48 may be placed so that the corners 46 of the object 48 are inserted from the front 50 of sheet 42, or alternatively so that the corners 46 of object 48 are inserted from the back 52 of sheet 42. In the latter case, the photograph or other object 48 will be somewhat protected by sheet 42.

Yet another embodiment of the removable hanger unit is shown in FIG. 6 and is designated as reference numeral 54. Hanger unit 54 comprises electrostatic sheet 56 and hanger member 58. Sheet 56 has an opening 60 cut therein. Opening 60 is configured so that hanger member 58 may have a portion thereof that may be inserted into opening 60 to hold hanger member 58 between sheet 56 and non-porous surface 18. Opening 60 may have different configurations when different hanger members 58 are used. For example, referring to FIG. 6, hanger member 58 may be seen to have a hook 62 and a backing hanger 64, the backing hanger 64 fitting into opening 60, and fitting between sheet 56 and surface 18, with the hook extending away from the front 66 of sheet 56. In this situation, opening 60 need only be big enough to slide either hook 62 or backing hanger 64 therethrough. Backing hanger 64 will then be positioned between sheet 56 and surface 18. The electrostatic interface between surface 18 and sheet 56 will support hanging member 58 therebetween, allowing an object to be hung from hanging member 58. Alternatively, hanging member 58 may be fused or glued to sheet 56 on its front surface 66.

Another configuration of a hanger member is shown in FIG. 7 and designated as number 67. In this configuration, hanger member 67 comprises a backing plate 68 and a hanging extension 70. Hanging extension 70 may be a hook, a clip, and the like, and extends outwardly from front 72 of backing plate 68. Backing plate 68 may have a plurality of beveled surfaces 74, as is best shown in FIG. 7. These beveled surfaces 74 each have as a base edge one outer edge 76 of backing plate 68. Hanging extension 70 may extend substantially perpendicularly from backing plate 68, or extend at an angle between vertical and horizontal which is less than ninety degrees measured from the top of the sheet 56. In this configuration, the opening 60 in electrostatic sheet 56 need only be sufficiently large enough to accommodate the placement of hanging extension 70 therethrough. Backing plate 68 is held between electrostatic sheet 56 and non-porous surface 18, allowing an item or object to be hung from 5 hanging extension 70. Beveled surfaces 74 may allow sheet 56 to better hold hanger member 67 between surface 18 and sheet 56. Again, as has been mentioned, hanger member 67 may be fused or glued to sheet 56.

Yet another alternative embodiment of the removable hanger unit is shown in FIG. 9 and is designated as reference numeral 78. In this configuration, a strip of electrostatic material 80 is doubled over at a fold point 82, so that end 84 of electrostatic strip 80 may contact and adhere to the main body 86 of electrostatic strip 80. Opposite end 88 of electrostatic strip 80 may then be adhered to non-porous surface 18 to create a hanging strip designated as 78. At fold point 82, an opening 90 may be made in electrostatic strip 80 through which a hanging member such as hanging member 58 may be inserted.

Yet another embodiment of the removable hanger unit is designated as reference numeral 92 and is shown in FIG. 8. Hanger unit 92 comprises an electrostatic sheet 94, a shelf 96, a support brace 98, and upper and lower backing support members 100 and 101. Electrostatic sheet 94 has openings 102 behind which backing support members 100 and 101 may be held, the backing support members 100 and 101 being sandwiched between electrostatic sheet 94 and a non-porous surface 18. Shelf 96 may then be attached to upper backing support member 100 by snap joint 104. Similarly, one end 106 of brace 98 is attached to lower backing support member 101 by snap joint 108, and opposite end 110 of brace 98 is attached to the bottom 112 of shelf 96 by snap joint 114. The electrostatic sheet 94 will hold backing support members 100 and 101 to non-porous surface 18 by sandwiching them between surface 18 and sheet 94, allowing shelf 96 and brace 98 to be attached thereto with snap joints 104 and 108, to provide a hanger unit 92 which may support an object such as object 116. It is understood that other joint formations may be employed with appropriate modification, and that support members 100 and 101 may be fused or glued to sheet 94.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

What is claimed:

1. A removable shelf and mounting unit for electrostatic mounting to a non-porous surface, said shelf and mounting unit comprising:

a sheet of electrostatically charged material having at least one opening therein; and a shelf having a mounting plate, said mounting plate adapted to engage said opening and be held therein by said sheet.

2. A shelf and mounting unit as described in claim 1, wherein said mounting plate and said shelf are substantially perpendicular to one another.

3. A shelf and mounting unit as described in claim 1, wherein said shelf further comprises a shelf brace extending from the bottom of said shelf.

4. A shelf and mounting unit as described in claim 3, wherein said brace is triangular.

5. A shelf and mounting unit as described in claim 1, wherein said shelf is light weight plastic.

6. A removable hanger unit for electrostatic mounting to a non-porous surface, comprising:

a sheet of electrostatically charged material having at least one opening therein; and a hanger member adapted to engage said opening and be held therein by said sheet.

7. A hanger unit as described in claim 6, wherein said hanger member comprises:

a mounting base; and a hook extending from said base.

8. A hanger unit as described in claim 7, wherein said base is metal.

9. A hanger unit as described in claim 7, wherein said mounting base is substantially rectangular, and has four beveled surfaces, each surface substantially triangular in shape, and each said surface having as its surface base one side of said mounting base.

10. A hanger unit as described in claim 7, wherein said base is molded plastic.

11. A hanger unit as described in claim 6, wherein said hanger member comprises:

a hook portion and a support portion, said hook portion extending from said support portion.

12. A picture hanger as described in claim 6, wherein said hanger member comprises:

a mounting base; and a clip extending from said base.

13. A removable hanger unit for mounting to a non-porous surface, comprising:

a strip of electrostatically charged material having a first end and a second end, and a central portion between said ends, said second end doubled over at a fold line to electrostatically engage said central portion, and having an opening near said fold line; and a hanger member adapted to engage said opening and be held therein.

14. A picture hanger for electrostatic mounting of an object to a non-porous surface, comprising:

a sheet of electrostatic material, wherein said sheet of electrostatic material has a plurality of holding openings therein, said holding openings spaced apart to be able to hold a picture or other flat object thereto.

15. A picture hanger as described in claim 14, wherein said holding openings are four slits in said sheet, said slits spaced apart to be able to hold a rectangular object by its corners.

16. A picture hanger for electrostatic mounting of an object to a nonporous surface, comprising:

a sheet of electrostatic material having a front surface and a back surface, said back surface electrostatically adhering the object to the non-porous surface by holding the object between said back surface and the non-porous surface.

17. A picture hanger as described in claim 16, and further comprising:

a shelf having a mounting plate, said mounting plate fixedly attached to said front surface of said sheet of electrostatic material.

* * * * *